US006932727B2

(12) United States Patent
Kramer

(10) Patent No.: US 6,932,727 B2
(45) **Date of Patent: *Aug. 23, 2005**

(54) BASEBALL AND SOFTBALL BAT GRIP

(76) Inventor: Robert M. T. Kramer, 3032 E. Commercial Blvd., Fort Lauderdale, FL (US) 33308

( * ) Notice: Subject to any disclaimer, the term of this patent is extended or adjusted under 35 U.S.C. 154(b) by 0 days.

This patent is subject to a terminal disclaimer.

(21) Appl. No.: 10/726,860

(22) Filed: Dec. 2, 2003

(65) Prior Publication Data

US 2004/0180739 A1 Sep. 16, 2004

Related U.S. Application Data

(63) Continuation-in-part of application No. 09/659,770, filed on Sep. 11, 2000, now Pat. No. 6,752,731, which is a continuation-in-part of application No. 09/179,600, filed on Oct. 27, 1998, now abandoned, which is a continuation-in-part of application No. 08/581,455, filed on Dec. 29, 1995, now Pat. No. 5,839,983, which is a continuation-in-part of application No. 08/187,308, filed on Jan. 25, 1994, now abandoned, which is a continuation-in-part of application No. 08/089,712, filed on Jul. 9, 1993, now abandoned.

(51) Int. Cl.[7] ..... A63B 59/06
(52) U.S. Cl. ..... 473/568
(58) Field of Search ..... 473/568, 564–567, 473/519, 520, 457

(56) References Cited

U.S. PATENT DOCUMENTS

| | | | | | |
|---|---|---|---|---|---|
| 1,573,612 | A | | 2/1926 | Johnston | |
| 2,091,458 | A | | 8/1937 | Sleight | |
| 2,101,714 | A | * | 12/1937 | Keeney | 427/341 |
| 2,984,486 | A | | 5/1961 | Jones | |
| 3,104,876 | A | | 9/1963 | Salsinger | |
| 3,410,017 | A | | 11/1968 | Wilson | |
| 4,134,198 | A | * | 1/1979 | Briggs | 29/450 |
| 5,005,254 | A | * | 4/1991 | Uffindell | 16/421 |
| 5,482,270 | A | * | 1/1996 | Smith | 473/568 |
| 5,571,050 | A | * | 11/1996 | Huang | 473/300 |
| 5,577,722 | A | * | 11/1996 | Glassberg | 473/457 |
| 6,752,731 | B1 | * | 6/2004 | Kramer | 473/568 |

* cited by examiner

*Primary Examiner*—Mark S. Graham
(74) *Attorney, Agent, or Firm*—Malin, Haley & DiMaggio, P.A.

(57) ABSTRACT

A one body member solid molded bat handle grip manufactured from thermoplastic material or the likes for improving the gripping control of the batter for baseball or softball, which is useful for left handed or right handed players. The longitudinal raised surface along the bat handle grip allow the batter alignment of the knuckles for proper wrist roll. The grip is capable of stretching over the bat knob onto the bat handle and sized for being grasped by both hands of the user.

4 Claims, 3 Drawing Sheets

BASEBALL AND SOFTBALL BAT GRIP

This application is a continuation-in-part of U.S. application Ser. No. 09/659,770, filed Sep. 11, 2000 now U.S. Pat. No. 6,752,731 which was a continuation-in-part of Ser. No. 09/179,600, filed Oct. 27, 1998 now abandoned which was a continuation-in-part of Ser. No. 08/581,455, filed Dec. 29, 1995 now U.S. Pat. No. 5,839,983 which is a continuation-in-part of U.S. patent application Ser. No. 08/187,308, filed Jan. 25, 1994, now abandoned which is a continuation-in-part of application Ser. No. 08/089,712, filed Jul. 9, 1993 now abandoned.

BACKGROUND OF THE INVENTION

1. Field of the Invention

This invention relates to a hand grip for baseball and softball bats. The invention is a one body member molded from thermoplastic or similar material for stretching over the bat knob on to the bat handle for being gripped with two hands of the batter providing knuckle alignment and for proper wrist roll and for increasing the gripping control and reducing vibration, sting and blistering to the hands of the batter and is adjustable around the bat handle but essentially immovable when manually squeezed by the batter.

2. Description of Related Art

The game of baseball and softball at all levels is typically played with either a wood or an aluminum bat, and is used to strike the ball. Although major baseball leagues still only use wooden bats, professional and amateur softball leagues, baseball and softball college leagues, high school baseball and softball leagues and little league baseball and softball mostly use aluminum bats. Heretofore, players often use batting gloves to increase their gripping control when gripping the bat handle of the bat when striking the ball. Often the aluminum bat grip surface is made of a leather or synthetic wrapped grip that can be slippery, especially if the batters hands are sweaty or wet from the rain. When players use wooden bats, an additional gripping additive is used of pine tar with batting gloves to achieve a better grip on the wooden bat. Using tar on wooden bats with batting gloves is often an unpleasant experience because of the sticky substance attaches to anything the player's touch. Baseball and softball players often use tap for their bat grip, but the drawbacks of this grip is the tap quickly becomes worn out and is then no longer suitable until replaced.

The present invention overcomes the problems of the prior art by providing for a substantial one body injected molded member bat grip that allows for added bat gripping control and power for any batter using an aluminum or wooden bat. The grip includes a raised surface portion for the batter to increase the gripping control and swing power by providing for proper knuckle alignment and is manufactured from a soft sticky material, thermoplastic or the likes, reducing slippage by the batter's hands when sweaty and reducing slippage when batters are batting in the rain, and can expand up to two and one half (2½) times the original size for stretching the grip over the bat knob onto the bat handle.

In alternative embodiments of the invention, one embodiment includes a plurality of finger receiving channels disposed about a longitudinally raised portion of the grip. In another embodiment, the invention includes the disposed longitudinal raised portion with finger separating barriers to allow individual fingers of the batter to grasp the grip. In other embodiments of the invention, the disclosed embodiments can also include a bottom outer portion that is tapered, starting approximately three inches (3") from the bottom of the grip and tapering down to the bottom end of the grip. In all the embodiments of grip options presented, it is further declared the invention is manually adjustable around the bat handle.

SUMMARY OF THE INVENTION

A grip for use with a ball bat such as a baseball or softball bat used to play the game of baseball and softball. The grip is comprised of a solid one body member and open at both ends and sized to fit movably snug around the bat handle, sized in length for being grasped by two hands simultaneously by the batter and having a single asymmetrical integral continuous longitudinal raised exterior surface portion for knuckle alignment and increasing the gripping control of the batter. The body member is composed of a material such as thermoplastic or the likes with a hardness that can be from 15 shore A to 30 shore A as the soft material for stretching over the bat knob onto the bat handle and creates a good surface for contact by the player's hands.

The one body member grip can also include a plurality of finger channels, or finger separating barriers, at least eight, in a side by side array along the raised exterior surface of the device to give the fingers of the user added gripping control.

The grip can also be molded as a solid one body member grip with the bottom outer portion tapered, starting approximately (3") from the bottom of the grip and tapering to the bottom end of the grip and can include a plurality of finger channels, or finger separating barriers, in a side by side array along the raised exterior surface.

The invention (in all the disclosed embodiments) once installed onto the bat can be manually rotated around the bat handle to the users likes and to prolong the life of aluminum bats.

It is therefore a principal object of this invention to provide an improved baseball or softball bat grip.

It is yet still another object of the invention to provide for an improved hand grip for a bat that can reduce vibration, stinging, and blistering to the hands and providing added bat control for the user.

In accordance with these and other objects which will be apparent hereinafter, the instant invention will now become described with particular reference to the accompanying drawings.

DETAILED DESCRIPTION

Figure 1:
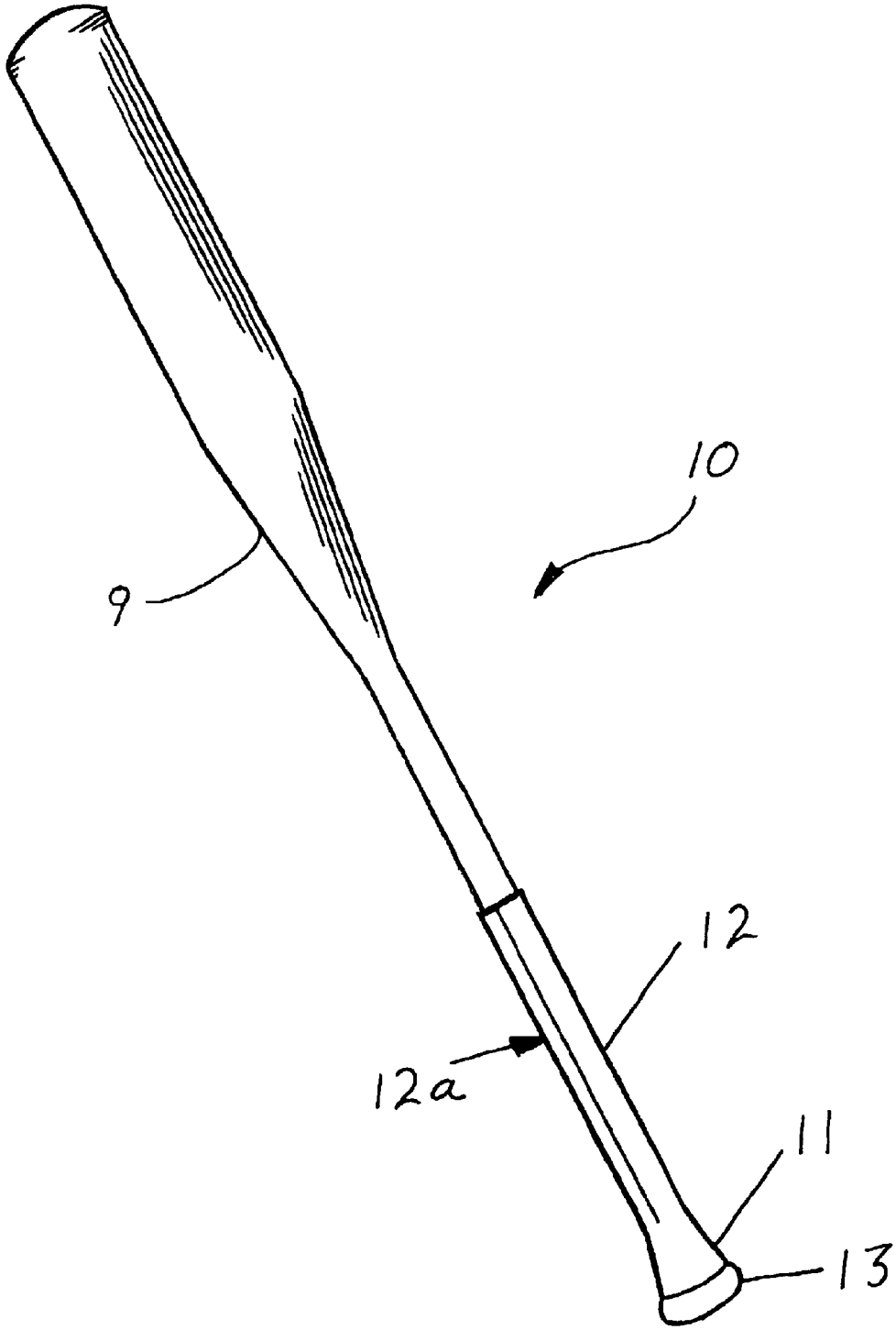
FIG. 1 shows a side elevation view of the embodiment of the invention with the bottom tapered portion, installed on a baseball bat.

Referring now to the drawings, and in particular FIG. 1, the present invention is shown generally at 10, comprised of a combination tapered bottom portion 11 as a one body member grip 12 attached around the handle of a baseball bat 9 and the knob of the bat 13 is exposed.

The grip 12 is a one body member molded bat grip as a solid unit from thermoplastic material or the like that is open at both ends including a tapered bottom portion and having a raised portion that is disposed longitudinally 12*a* to knuckle alignment. Figure 13 shows the knob of a baseball bat. The batter can manually pull and move the raised asymmetrical exterior surface hand grip around the bat handle until a desired location is found which provides for rotated ball impact to aluminum bats for prolonging the life of the aluminum bats. The batter can also move the hand grip around the bat handle of wooden bats to line up the bat label and batters grip for proper grip alignment. Once the grip has been rotated around the bat handle to the position desirable by the batter, then the grip will stay in that position because the inside cylindrical passage size 15 of the grip is up to 0.150 inches smaller then the outside diameter of the bat handle allowing the molded grip that is manufactured from thermoplastic material or the likes with a hardness that can be from 15 shore A to 30 shore A for stretching over the bat knob to fit firmly around the bat.

Figure 2A:
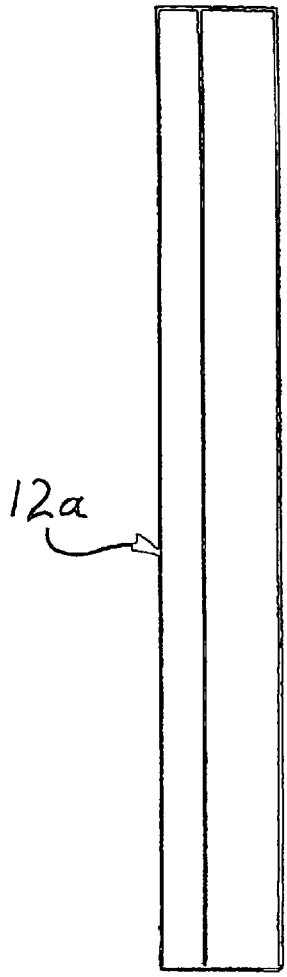
FIG. 2A shows a side elevation view of an alternate embodiment of the invention.

FIG. 2A shows an alternate embodiment of the grip without the bottom tapering portion 11, and includes the raised ridge 12*a* for knuckle alignment that can be 0.250 inches at the highest point and the opposite or back side of the grip is approximately 0.030 inches thick.

Figure 3A:
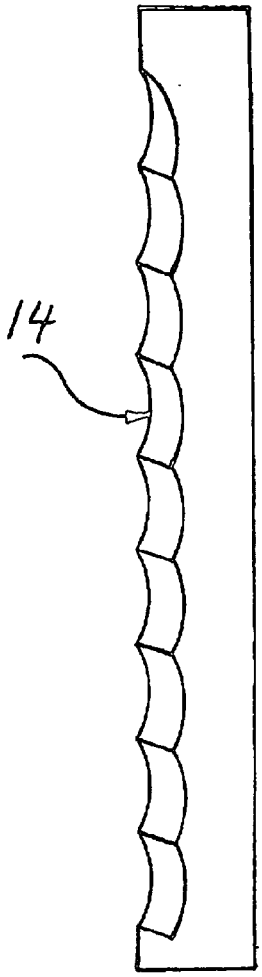
FIG. 3A shows a side elevation view of an alternate embodiment of the invention.
Figure 3B:
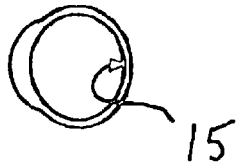
FIG. 3B shows a top plan view of the embodiment shown in FIG. 3A.

FIG. 3A shows an alternate embodiment of the invention with out the bottom tapering portion with the remainder of the structure being similar and includes the exterior raised ridge with finger receiving channels 14 for added bat control. FIG. 3B shows the top plan view of FIG. 3A.

Figure 4A:
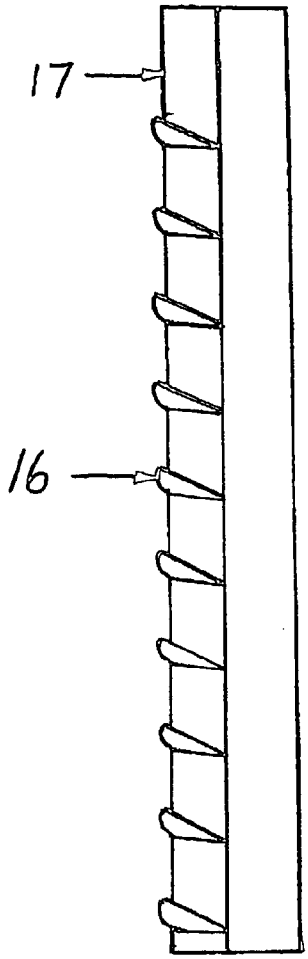
FIG. 4A shows a side elevation view of an alternate embodiment of the invention.
Figure 2B:
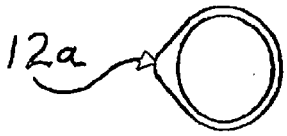
FIG. 2B shows a top plan view of the embodiment shown in FIG. 2A.
Figure 4B:
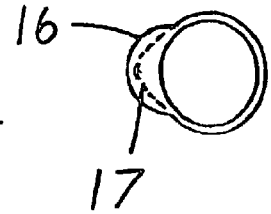
FIG. 4B shows a top plan view of the embodiment shown in FIG. 4A.

FIGS. 4A and 4B show the embodiment with out the bottom tapering portion that include separating barriers 16 for the fingers for both hands simultaneously while at the same time having a raised ridge 17 that provides for knuckle alignment while the fingers are separated by separating barriers 16.

Figure 2C:
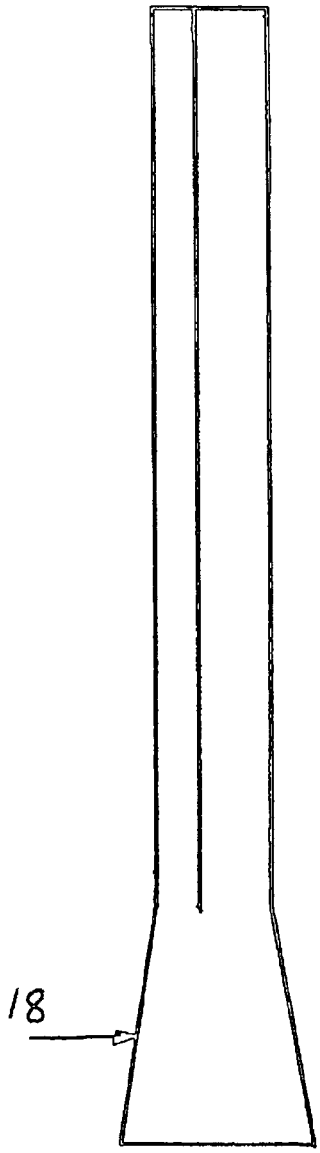
FIG. 2C shows a side elevation view shown in FIG. 1 without the baseball bat.
Figure 3C:
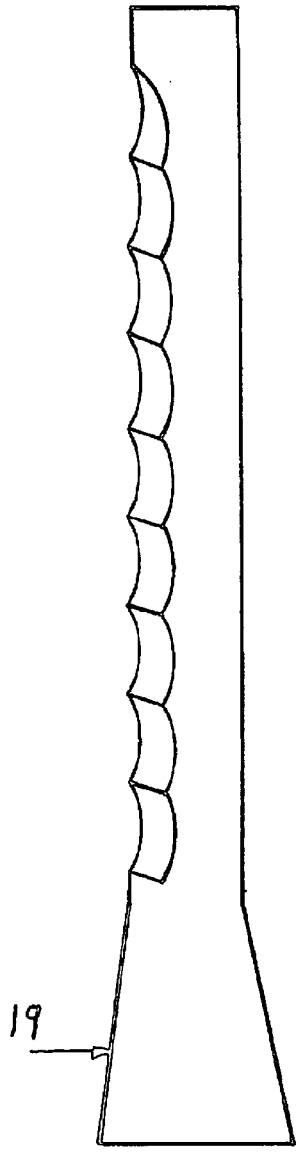
FIG. 3C shows a side elevation view of an alternate embodiment of the invention.
Figure 4C:
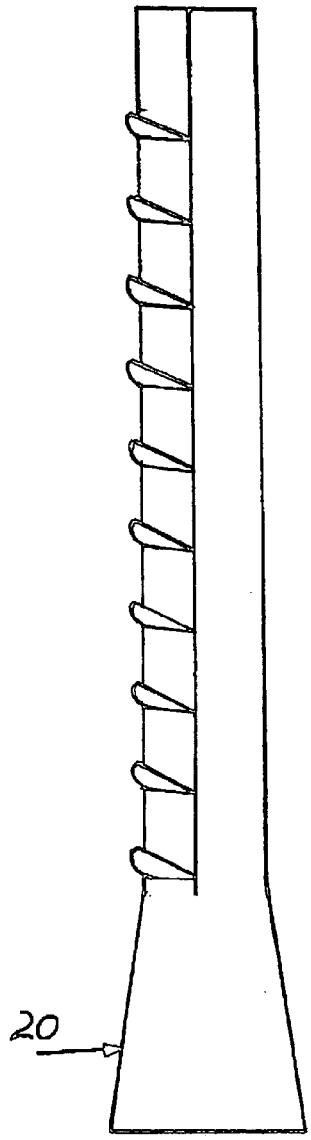
FIG. 4C shows a side elevation view of an alternate embodiment of the invention.
Figure 2D:
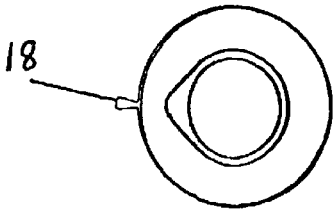
FIG. 2D shows a top plan view of the embodiment shown in FIG. 2C.
Figure 3D:
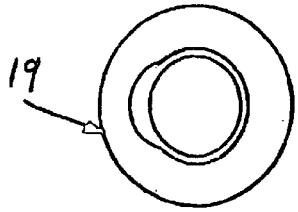
FIG. 3D shows a top plan view of the embodiment shown in FIG. 3C.
Figure 4D:
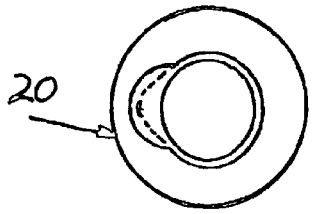
FIG. 4D shows a top plan view of the embodiment shown in FIG. 4C.

FIG. 2C shows an alternate embodiment of the invention and the structure being similar to FIG. 2A that includes the bottom tapering portion 18 to allow the bottom hand of the batter added gripping around the bat knob and tapering portion simultaneously. FIG. 2D shows the top plan view of FIG. 2C. FIG. 3C shows an alternate embodiment of the grip and the structure being similar to FIG. 3A in conjunction with the bottom tapering portion 19 again, to allow the bottom hand of the batter added gripping around the bat knob and tapering portion simultaneously. FIG. 3D shows the top plan view of FIG. 3C. FIG. 4C shows yet another alternate embodiment of the grip and the structure also being similar to FIG. 4A including the bottom tapering portion 20 allowing the bottom hand of the batter added gripping around the bat knob and tapering portion simultaneously. FIG. 4D shows the top plan view of FIG. 4C.

The invention has been shown and described herein in what is considered to be the most practical and preferred embodiments, FIG. 2A and FIG. 2C. It is recognized, however, that departures may be made there from within the scope of the invention and that obvious modifications will occur to a person skilled in the art.

What is claimed is:

1. A one body member molded baseball and softball bat handle grip, said body member manufactured to be a solid one body member that is molded from Thermoplastic material or the likes with a hardness that can be from 15 shore A to 30 shore A for allowing the inside cylindrical passage size to expand up to two and one half (2½) times the original size for stretching over the bat knob on to the bat handle, said body member having an inside cylindrical passage sized to fit movably snug around the bat handle and including a single continuous longitudinal, raised exterior surface portion for knuckle alignment and for proper wrist roll and for increasing the gripping control, sized in length for being grasped by two hands simultaneously by the batter and the bottom outer portion is tapered, starting approximately three inches (3") from the bottom and tapering outwards down to the bottom and said grip is for reducing vibration, sting and blistering on the hands of the batter and said one body member being open at the top and bottom end; and said body member being manually adjustable around the bat handle essentially immovable when manually squeezed by the batter.

2. A ball bat grip as in claim 1, wherein body member exterior raised surface portion include a plurality of finger receiving channels disposed about that part of body member but not disposed about the bottom tapered portion of body member.

3. A ball bat grip as in claim 1, wherein body member exterior raised surface portion include a plurality of finger separating barriers spaced apart sufficiently to allow individual fingers to be received between adjacent finger separating barriers about that part of body member but not disposed about the bottom tapered portion of body member.

4. A ball bat grip as in claim 1, wherein said body member fits movably snug around a wooden bat handle for manually adjusting the grip around the bat handle to line up the bat label and batters grip for proper grip alignment with the wooden bat label.

* * * * *